United States Patent [19]

West

[11] Patent Number: 4,541,917

[45] Date of Patent: Sep. 17, 1985

[54] MODIFIED DEOILING-DEWAXING PROCESS

[75] Inventor: Theodore H. West, Sarnia, Canada

[73] Assignee: Exxon Research and Engineering Co., Florham Park, N.J.

[21] Appl. No.: 562,698

[22] Filed: Dec. 19, 1983

[51] Int. Cl.[4] ..... C10G 73/04

[52] U.S. Cl. ..... 208/31; 208/33

[58] Field of Search ..... 208/33, 31, 30, 38

[56] References Cited

U.S. PATENT DOCUMENTS

| | | | |
|---|---|---|---|
| 1,999,486 | 4/1935 | Smith | 196/19 |
| 2,165,807 | 7/1939 | Murphree et al. | 210/63 |
| 2,180,070 | 11/1939 | Smith | 196/18 |
| 2,397,868 | 4/1946 | Jenkins | 208/30 |
| 2,654,692 | 10/1953 | Kiersted, Jr. et al. | 208/31 |
| 2,949,418 | 8/1960 | Jezl | 208/30 |
| 3,014,859 | 12/1961 | Royder | 208/33 |
| 3,294,672 | 12/1966 | Torobin | 208/28 |
| 3,458,430 | 7/1969 | Henselman et al. | 208/33 |
| 3,644,195 | 2/1972 | Gudelis et al. | 208/31 X |
| 3,658,688 | 4/1976 | Berebauer et al. | 208/31 |
| 3,773,650 | 11/1973 | Hislop et al. | 208/33 |
| 3,775,288 | 11/1973 | Eagen et al. | 208/33 |
| 3,806,442 | 4/1974 | Reid et al. | 208/33 |
| 3,846,277 | 11/1974 | McIntosh | 208/31 |
| 4,146,461 | 3/1979 | Broadhurst et al. | 208/33 |
| 4,191,631 | 3/1980 | Grisham, Jr. | 208/33 |
| 4,192,732 | 3/1980 | Onodera et al. | 208/33 |
| 4,368,112 | 1/1983 | Thompson et al. | 208/31 |

FOREIGN PATENT DOCUMENTS

| | | |
|---|---|---|
| 476306 | 11/1975 | U.S.S.R. . |
| 513070 | 5/1976 | U.S.S.R. . |

*Primary Examiner*—D. E. Gantz
*Assistant Examiner*—Glenn Caldarola
*Attorney, Agent, or Firm*—Joseph J. Allocca

[57] ABSTRACT

Refined waxes and dewaxed lubricating oil basestocks are simultaneously produced in a reversed deoiling-dewaxing process employing conventional dewaxing solvents and existing process equipment. Improved yields, lower solvent useage, and higher throughputs are achieved using dewaxing aids in the final stage. Waxy hydrocarbon oils are solvent dewaxed to a temperature which produces a low oil content refined high melting point hard wax product which is recovered, e.g. by filtration. The hard wax product can be deoiled. The filtrate from the initial dewaxing operation is then injected with dewaxing aid and further chilled in secondary chiller means such as scraped surface chillers to a lower temperature to produce more deeply dewaxed oil and a low melting point soft wax product which are separated e.g. by filtration. The low melting point wax is desolvated and the dewaxing aid may be recovered for example by passing the wax through a membrane or by distillation. Any recovered dewaxing aid may be recycled to the process.

16 Claims, 1 Drawing Figure

MODIFIED DEOILING- DEWAXING PROCESS

MODIFIED DEOILING-DEWAXING PROCESS

DESCRIPTION OF THE INVENTION

Refined waxes and dewaxed lubricating oil basestocks are simultaneously produced in a reversed deoiling-dewaxing process employing conventional dewaxing solvents and existing process equipment. Improved yields, lower solvent useage, and higher throughputs are achieved using dewaxing aids in the final stage. Waxy hydrocarbon oils are solvent dewaxed to a temperature which produces a low oil content refined high melting point hard wax product which is recovered, e.g. by filtration. The hard wax product can be deoiled. The filtrate from the initial dewaxing operation is then injected with dewaxing aid and further chilled in secondary chiller means such as scraped surface chillers to a lower temperature to produce more deeply dewaxed oil and a low melting point soft wax product which are separated e.g. by filtration. The low melting point wax is desolvated and the dewaxing aid may be recovered for example by passing the wax through a membrane or by distillation. Any recovered dewaxing aid may be recycled to the process.

THE INVENTION

Figure 1:
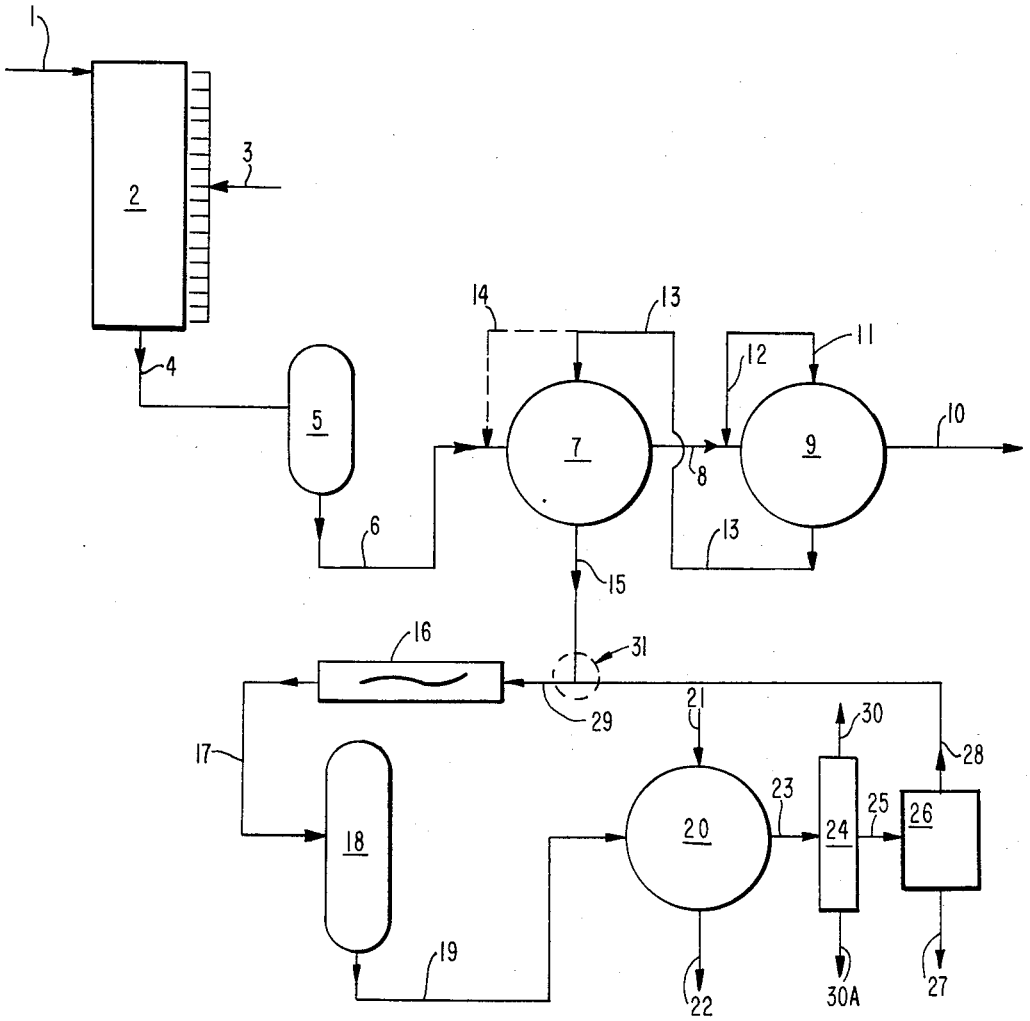
FIG. 1 is a schematic of an embodiment of the reversed deoiling-dewaxing process of the present invention.

The process of the present invention constitutes an improved method for simultaneously dewaxing waxy hydrocarbon oils preferably waxy petroleum oils, most preferably waxy distillates, raffinates or bright stocks, especially those which are categorized as being lube, transformer oil, turbine oil, white oil or kerosene basestocks, and for producing separately recovered wax products, i.e. high melting point hard waxes of low oil content and low melting point soft waxes.

In the practice of the present invention the waxy hydrocarbon oil is dewaxed using conventional dewaxing procedures and apparatus. The waxy oil can be chilled in the presence or absence of a dewaxing solvent to a temperature low enough to crystallize out the hard wax. Preferably, however, this first chilling to crystallize out the hard wax is performed using a dewaxing solvent. For example the waxy oil can be dewaxed by total predilution using scraped surface chiller apparatus in which the waxy hydrocarbon oil, with or without prior heating but preferably with prior heating to insure dissolution of all the wax present therein, is mixed with a quantity of dewaxing solvent to give a dilution of about 1/1 to 10/1 solvent to waxy oil. This solvent/oil mixture is then fed to a scraped surface chiller wherein the mixture is chilled to a wax separation temperature via indirect chilling. This chilling in the present invention is to a temperature sufficient to crystallize out the high melting point hard waxes and is typically to about 10° to 130° F., preferably about 25° to 90° F., most preferably about 35° to 60° F.

Another method of solvent dewaxing involves conventional, incremental solvent addition. In this method, solvent is added to the oil at several points along a chilling apparatus. However, the waxy oil is first chilled with solvent until some wax crystallization has occurred and the mixture has thickened considerably. A first increment of solvent is introduced at this point in order to maintain fluidity, cooling continues and more wax is precipitated. A second increment of solvent is added to maintain fluidity. This process is repeated until the desired oil-wax filtration temperature is reached, at which point an additional amount of solvent is added in order to reduce the viscosity of the mixture to that desired for the filtration step. In this method the temperature of the incrementally added solvent should also be about the same as that of the wax/oil/solvent mixture at the point of introduction. If the solvent is introduced at a lower temperature, shock chilling of the slurry usually occurs, resulting in the formation of small and/or acicula shaped wax crystals with attendant poor filter rate.

Again, in the present invention, this first chilling is to a temperature sufficient to crystallize out the high melting point hard waxes.

Another solvent dewaxing procedure which can be employed in the present invention involves the use of cold dewaxing solvent which is directly injected into the waxy hydrocarbon oil under conditions of high agitation to effect substantially instantaneous mixing. This procedure uses an elongated multi stage chilling vessel with injection occurring in a number of (or all of) the stages, at least those stages wherein injection is occurring being subjected to high agitation to insure the substantially instantaneous mixing of the cold solvent and the waxy oil, resulting in the precipitation of at least a portion of the wax which, in the present invention is the hard wax. This process, which goes by the designation DILCHILL is covered in greater detail in U.S. Pat. No. 3,773,650, while a modification thereof which employs the aforementioned high agitation direct chilling zone augmented by a subsequent, separate and distinct scraped surface indirect chilling zone is presented in U.S. Pat. No. 3,755,288, the disclosures of both of which are incorporated herein by reference.

The solvent/oil/wax crystal slurry from the initial solvent dewaxing unit of whatever type is then separated using typical liquid/solid separation equipment, such as filters or centrifuge to yield a low oil content hard wax cake and a dewaxed oil filtrate. This separation by filtration or centrifugation can take the form of a single stage or multiple stage operation. If necessary or desired, the recovered hard wax cake can be deoiled. In the balance of this specification and in the claims appended hereto we shall refer to "filtration" and "filtrate" for simplicity, it being understood that any separation procedure can be employed.

If the chilling has been performed using no solvent, cold solvent can be added just prior to the separation step to help facilitate separating the crystallized hard wax from the oil. Hard wax crystallized in the absence of solvent will have a relatively high oil content and will require additional processing to produce an oil-free hard wax product.

Filtrate from this separation procedure is then injected with dewaxing aid. Again, if no solvent has been used in the previous steps a volume of solvent is added at this time. If the previous dewaxing steps were conducted using a dewaxing solvent, an additional, optional volume of solvent can be added. The mixture of dewaxing aid/solvent/filtrate (from the previous step) is then further chilled in, for example, scraped surface chillers to a still lower temperature to produce a deeply dewaxed oil and low melting point soft wax slurry. Typical dewaxing aids are those which are effective on the lower melting point waxes. Examples of useful candidates are low molecular weight polyalkylmethacrylate polymers such as Rohm and Haas Acryloid 144 and Acryloid 150, polyalkylacrylates such as Shellswim 170, wax naphthalene condensates such as Paraflow 149. Typical active ingredient level of these aids is 25–35% and typical aid dosages would run from 0.3 to 2% (broad range 0.1 to 6%) on an as received basis on waxy feed charge. This slurry comprising solvent, deeply dewaxed oil and soft wax crystals is then itself sent to liquid/solid separation process equipment (again, filters, centrifuges, etc) and separated into dewaxed oil/solvent stream and a soft wax cake.

The recovered soft wax cake is subjected to oil and solvent removal by procedures such as warmup deoiling and/or distillation while the dewaxed oil/solvent stream can be separated into an oil stream and a solvent stream by procedures such as distillation or membrane separation as described in the U.S. Pat. No. 4,368,112, European Patent Application Publication No. 13,834 or U.S. Ser. No. 494,543.

Optionally, the solvent free soft wax can be separated from the dewaxing aid, using, e.g. distillation (see e.g. U.S. Pat. No. 4,192,732), membrane separation, etc.

The recovered dewaxing aid can be recycled to the dewaxing process recited above (i.e., the filtrate dewaxing step).

Illustrative, non-limiting examples of waxy stocks are (a) distillate fractions that have a boiling range within the broad range of about 500° F. to about 1300° F., with preferred stocks including the lubricating oil and specialty oil fractions boiling within the range of between about 50° F. and 1200° F., (b) bright stocks and deasphalted resids having an initial boiling point about 800° F., and (c) broad cut feedstocks that are produced by topping or distilling the lightest material off a crude oil leaving a broad cut oil, the major portion of which boils above about 500° F. or 650° F. Additionally, any of these feeds may be hydrocrakced prior to distilling, dewaxing or topping. The distillate fractions may come from any source, such as the paraffinic crudes obtained from Armaco, Kuwait, the Pan Handle, North Louisiana, etc., naphthenic crudes, such as Tia Juana, Coastal crudes, etc., as well as the relatively heavy feedstocks, such as bright stocks having a boiling range of 1050+°F. and synthetic feedstocks derived from Athabasca Tar Sands, shale, etc. Waxy petroleum oil stocks are preferred and the most preferred stocks are the waxy lube, and specialty oil stocks, such as wax transformer oil, white oil and turbine oil stocks.

Any solvent useful for dewaxing waxy hydrocarbon oil stocks may be used in the process. Representative examples of such solvents are (a) the aliphatic ketones having from 3 to 6 carbon atoms, such as acetone, methyl ethyl ketone (MEK) and methyl isobutyl ketone (MIBK), and (b) mixtures of the aforesaid ketones with $C_6$–$C_{10}$ aromatics such as benzeine, xylene and toluene. In addition, halogenated, low molecular weight hydrocarbons, such as the $C_1$–$C_4$ chlorinated hydrocarbons, e.g., dichloromethane, dichloroethane, and mixtures thereof, may be used as solvents either alone or in admixture with any of the aforementioned solvents. Preferred solvents are MEK/MIBK and MEK/toluene.

By practicing this sequence of chilling, separating into high melting point wax/dewaxed oil (filtrate), injecting dewaxing aid into said filtrate, further chilling, recovering low melting point wax and deeply dewaxed oil and separating dewaxing aid from the low melting point wax, the overall process exhibits the following advantage. Compared with conventional dewaxing processes which do not employ the intermediate steps of liquid/solid separation between the two chilling sequence and dewaxing aid addition to the filtrate from the first chilling step before being subjected to the second chilling, the present invention exhibits:

(1) reduced scraped surface chilling debit in the second chilling train following DILCHILL.
(2) reduced solvent circulation (up to 30%)
(3) higher overall dewaxed oil yield (+4%)
(4) no filtration/separation limitations
(5) no warmup of first stage wax to deoiling
(6) more efficient deoiling due to higher wash acceptance
(7) solvents are acceptable
(8) no contamination of refined wax by dewaxing aid
(9) dewaxing aid is optionally recovered from a non essential wax stream
(10) process applicable at lower solvent circulation where refined wax not required.

DETAILED DESCRIPTION OF THE FIGURE

The detailed description of the new process follows the flow plan shown in FIG. 1. Waxy feed (1) enters a DILCHILL tower (2) where it is contacted under multistage turbine agitation with chilled solvent (3). The partially chilled solvent-feed slurry exits the tower via line (4) to filter feed tank (5). Slurry exits tank (5) via line (6) to first stage vacuum filter (7). Wax cake from (7) exits via line (8) where it is repuddled with fresh solvent via line (12). Repuddled slurry enters second stage vacuum filter (9) where the wax cake is washed with fresh solvent via line (11). Low oil content refined hard wax exits via line (10) to wax recovery. Second stage filtrate is recycled to first stage filter (7) via line (13) where it is used primarily to wash the first stage wax cake. Excess wash not accepted by filter (7) can be added as predilution via alternate line (14).

First stage filtrate exits filter (7) via line (15) where it is mixed with a dewaxing aid at junction (29). The filtrate-dewaxing aid mixture passes through scraped surface chiller (16) where it is further chilled to the desired final dewaxing temperature. Chilled slurry exits chiller (16) via line (17) to third stage filter feed drum (18) and exits via line (19) to third stage filter (20). Wash solvent is applied via line (21) and dewaxed oil exits via line (22) to dewaxed oil recovery. Low oil content low melting point soft wax exits filter (20) via line (23) to oil/solvent recovery unit (24). In recovery unit (24) wax is separated from solvent (and any remaining oil) and the mixture of oil/solvent is separated into a solvent stream (30) and an oil stream (30A). Low melting point wax containing dewaxing aid exits via line (25) to dewaxing aid recovery unit (26) where dewaxing aid is separated from the low melting point wax. Low melting point wax exits via line (27) and the dewaxing aid rich stream exits via line (28) where it is recycled to the process at junction (29). Make up dewaxing aid may be added at junction (29) via line (31). Any solvent recovered from refined hard wax recovery (10) and dewaxed oil recovery (22) and solvent stream (30) from solvent recovery unit 24 are combined and recycled to the process via lines (3, 11, 12 and 21). These streams will require various degrees of chilling which are not shown.

EXAMPLES

Conventional 1 stage dewaxing and 2 stage deoiling are compared with the reverse deoiling, dewaxing process of the present invention practiced by employing a process sequence as described in the detailed description presented above. The comparative runs were conducted on Baton Rouge Barosa 56 and are presented in Examples 1 to 3 and Tables 1 to 3 below.

EXAMPLE 1

This experimental process simulation represents a typical multistage filtration process comprising dewaxing followed by warmup deoiling whereby dewaxed oil and refined waxes are produced simultaneously as described in U.S. Pat. No. 3,644,195. The waxy feed is Barosa 56, from a medium viscosity stream with a viscosity of 350 SUS at 100° F. Typical conditions for 1 dewaxing stage and 2 warmup deoiling stages are given in Table 1.

TABLE 1

| | Dewaxing | Warmup Deoiling |
|---|---|---|
| Process configuration | 1 stage | 2 stages |
| Fresh Solvent Volume | 4.9 | 1.2 |
| Total Fresh Solvent Volume | | 6.1 |
| Relative Feed Filter Rate | 1 | 3.7 |
| Relative Liquids/Solids | 1 | 0.9 |
| Dewaxed Oil Yield wt. % | 72 | — |
| % Oil in Wax | 27 | <1 |
| Wax Type | slack | Refined High Melting Point |
| Filter Temperature °C. | −18 | 22 |

This process employs high solvent volumes yet suffers from low dewaxed oil yields due to high slack wax oil contents and uses no dewaxing aid addition.

EXAMPLE 2

This simulation represents a version of the process scheme (deoiling preceeding dewaxing) as outlined in the current invention but demonstrates the low efficiency of the process when no dewaxing aid addition is used.

TABLE 2

| | Deoiling | Dewaxing |
|---|---|---|
| Process configuration | 2 stages | 1 stage |
| Fresh Solvent Volume | 2.6 | 0.4 |
| Total Fresh Solvent Volume | | 3.0 |
| Relative Feed Filter Rate | 1.9 | 1.3 |
| Relative Liquids/Solids | 0.7 | 2.8 |
| Dewaxed Oil Yield wt. % | — | 67.7 |
| % Oil in Wax | 0.6 | 76 |
| Wax Type | Refined High Melt Point | Low Melt Point |
| Stage Temperature °C. | 16 | −18 |

Although a fresh solvent savings of over 50% is demonstrated over example 1, dewaxed oil yields are lower due to higher liquids/solids and high wax oil contents obtained in the dewaxing stage.

EXAMPLE 3

This simulation represents the process scheme of the current invention (deoiling preceeding deep dewaxing) wherein a dewaxing aid is added to the dewaxing stage after refined wax is removed in the initial two deoiling stages. The data in Table 3 demonstrates the high efficiency of this process which demonstrates a +30% solvent savings as well as significantly improved dewaxed oil yields and filter rates.

TABLE 3

| | Deoiling | Dewaxing A or B | |
|---|---|---|---|
| Process Configuration | 2 stages | 1 stage | 1 stage |
| Dewaxing Aid Acryloid 150 wt. % added (as rec'd) on feed | 0 | 0.1 | 0.5 |
| Fresh Solvent Volume | 2.6 | 1.6 | 1.6 |
| Total Fresh Solvent Volume | 4.2 | | |
| Relative Feed Filter Rate | 1.9 | 1.7 | 4.4 |
| Relative Liquids/Solids | 0.7 | 1.6 | 0.5 |
| Dewaxed Oil Yield wt. % | — | 73.6 | 75.8 |
| % oil in wax | 0.6 | 27 | 9 |
| Wax Type | Refined High Melt Point | Low Melt Point | |
| Stage Temperature °C. | 16 | −18 | −18 |

What is claimed is:

1. A method for producing a hard wax product of low oil content and a deeply dewaxed oil product from a waxy hydrocarbon oil which method comprises the steps of:
   (a) dewaxing the wavy hydrocarbon oil, in the absence of dewaxing aid, at a temperature sufficient to crystallize the hard wax in said oil;
   (b) separating the crystallized hard wax from the hydrocarbon oil to yield a hard wax and an oil filtrate;
   (c) injecting a dewaxing aid and solvent into said recovered filtrate and chilling said dewaxing aid/filtrate/solvent mixture to a temperature sufficient to crystallize the low melting point wax;
   (d) separating the low melting point wax from the deeply dewaxed solvent/oil to yield a low melting point wax product and a solvent/deeply dewaxed oil filtrate; and
   (e) separating the solvent/deeply dewaxed oil filtrate into a solvent stream and a deeply dewaxed oil stream.

2. The method of claim 1 wherein dewaxing solvent is added to the precipitated hard wax-oil mixture of step (A) in order to facilitate the separation conducted in step (b).

3. A method for producing a hard wax product of low oil content and a deeply dewaxed oil product from a waxy hydrocarbon oil which method comprises the steps of:
   (a) solvent dewaxing the waxy hydrocarbon oil, in the absence of dewaxing aid, to a temperature sufficient to crystallize the hard wax in said oil;
   (b) separating the crystallized hard wax from the hydrocarbon oil to yield a hard wax product and an oil filtrate;
   (c) injecting a dewaxing aid into said recovered filtrate and chilling said dewaxing aid/filtrate mixture to a temperature sufficient to crystallize the low melting point wax;
   (d) separating the low melting point wax from the deeply dewaxed solvent/oil to yield a low melting point wax product and a solvent/deeply dewaxed oil filtrate; and
   (e) separating the solvent/deeply dewaxed oil filtrate into a solvent stream and a deeply dewaxed oil stream.

4. The method of claim 1, wherein the dewaxing aid added to the filtrate separated from the hard wax is selected from the low molecular weight polyalkyl(meth-)acrylate and wax-naphthalene condensation product.

5. The method of claim 3 wherein the dewaxing aid added to the filtrate separated from the hard wax is selected from the low molecular weight polyalkyl(meth-)acrylate and wax-naphthalene condensation product.

6. The method of claim 1 further comprising the steps of deoiling the low melting point wax product recovered in step (d).

7. The method of claim 3 further comprising the steps of deoiling the low melting point wax product recovered in step (d).

8. The method of claim 1 further comprising the steps of recovering the dewaxing aid from said low melting point wax.

9. The method of claim 3 further comprising the steps of recovering the dewaxing aid from said low melting point wax.

10. The method of claim 8 wherein the recovered dewaxing aid is recycled to the dewaxing process at step (c).

11. The method of claim 9 wherein the recovered dewaxing aid is recycled to the dewaxing process at step (c).

12. The method of claim 3, 5, 7, 9 or 11 wherein the solvent dewaxing to produce a crystalline hard wax is performed in a multi-stage chilling vessel wherein cold dewaxing solvent is injected into at least a few of the stages wherein in at least those stages where cold solvent is injected a condition of high agitation is maintained to effect the instantaneous mixing of the cold dewaxing solvent and the waxy oil.

13. The method of claim 12 wherein the chilling of the dewaxing aid/filtrate mixture is performed in scraped surface chillers.

14. The method of claim 13 wherein the dewaxing solvent is selected from $C_3$–$C_6$ ketones and mixtures thereof; $C_6$–$C_{10}$ aromatic hydrocarbons in combination with $C_3$–$C_6$ ketones; halogenated $C_1$–$C_4$ hydrocarbons.

15. The method of claim 14 wherein the dewaxing solvent is selected from methyl, ethyl ketone, methyl isobutyl ketone and mixtures thereof, and mixtures of methyl ethyl ketone and toluene.

16. The method of claim 1, 2, 3, 4, 5, 6, 7, 8, 9, 10 or 11 wherein the waxy hydrocarbon oil is selected from a waxy petroleum oil, a lube oil, transformer oil or turbine oil.

* * * * *